US006893016B2

(12) United States Patent
Pav et al.

(10) Patent No.: US 6,893,016 B2
(45) Date of Patent: May 17, 2005

(54) PRINT ON DEMAND INSERTER

(75) Inventors: Darrell E. Pav, Bethlehem, PA (US); Randy R. Seidel, Bethlehem, PA (US); Michael White, Bethlehem, PA (US)

(73) Assignee: Graphic Management Associates, Inc., Bethlehem, PA (US)

( * ) Notice: Subject to any disclaimer, the term of this patent is extended or adjusted under 35 U.S.C. 154(b) by 180 days.

(21) Appl. No.: 10/177,698

(22) Filed: Jun. 21, 2002

(65) Prior Publication Data

US 2003/0183097 A1 Oct. 2, 2003

Related U.S. Application Data

(60) Provisional application No. 60/368,781, filed on Mar. 29, 2002.

(51) Int. Cl.[7] ..... B65H 5/34

(52) U.S. Cl. ..... 271/270; 270/17

(58) Field of Search ..... 271/270, 69; 270/12, 270/17, 52.2, 1.01, 1.02; 347/4, 5; 198/792, 198

(56) References Cited

U.S. PATENT DOCUMENTS

| | | | | |
|---|---|---|---|---|
| 2,143,514 A | | 1/1939 | Hackbarth | |
| 3,119,864 A | | 1/1964 | Irvine | 564/10 |
| 3,960,079 A | | 6/1976 | Capetti | 101/232 |
| 4,149,711 A | | 4/1979 | Jackson | |
| 4,211,397 A | | 7/1980 | Hansen et al. | 271/4.01 |
| 4,295,643 A | | 10/1981 | de la Vega | 270/52.19 |
| 4,478,399 A | | 10/1984 | Morin et al. | 270/52.21 |
| 4,534,550 A | | 8/1985 | Reist | 271/183 |
| 4,546,962 A | | 10/1985 | Backman | 270/52.19 |
| 4,632,381 A | | 12/1986 | Cuir et al. | 271/270 |
| 4,723,770 A | * | 2/1988 | Seidel et al. | 270/52.2 |
| 4,874,161 A | | 10/1989 | Murasaki et al. | 271/265.01 |
| 4,989,850 A | * | 2/1991 | Weller | 270/1.02 |
| 5,005,815 A | * | 4/1991 | Auksi | 270/1.02 |
| 5,067,699 A | * | 11/1991 | Gadway et al. | 270/55 |
| 5,080,337 A | * | 1/1992 | Mayer et al. | 270/1.02 |
| 5,087,805 A | * | 2/1992 | Silverschotz et al. | 219/121.71 |
| 5,100,116 A | | 3/1992 | Graushar | |
| 5,114,128 A | * | 5/1992 | Harris et al. | 270/1.03 |
| 5,119,146 A | | 6/1992 | Nobumori et al. | 399/396 |
| 5,186,443 A | * | 2/1993 | Manley et al. | 270/1.02 |
| 5,299,797 A | | 4/1994 | Ricciardi | 271/150 |
| 5,819,663 A | * | 10/1998 | Klaas et al. | 101/483 |
| 6,019,047 A | * | 2/2000 | Klaas et al. | 101/483 |
| 6,267,366 B1 | | 7/2001 | Graushar | |

* cited by examiner

*Primary Examiner*—Donald P. Walsh
*Assistant Examiner*—Kenneth W. Bower
(74) *Attorney, Agent, or Firm*—Muserlian, Lucas & Mercanti

(57) ABSTRACT

A combined insert feeder and printer is employed such that blank inserts are stored in its hopper. The blank inserts are then fed by a transporter to a printer. The printer prints onto the insert to create a printed insert which is transported into a moving pocket.

18 Claims, 3 Drawing Sheets

PRINT ON DEMAND INSERTER

CROSS REFERENCE TO RELATED APPLICATIONS

This Application claims the benefit of U.S. Provisional Patent Application No. 60/368,781, filed Mar. 29, 2002.

BACKGROUND OF THE INVENTION

1. Field of the Invention

This Invention relates to insert machines or collating machines and, more particularly, to an insert printing device used with an insert machine wherein the device both prints and feeds inserts to a moving element. Such devices are especially suited for the graphic arts industry.

2. Art Relating to the Invention

Insert machines generally comprise a plurality of pockets mounted on an endless conveyor, a jacket feeder which inserts jackets (e.g. newspaper) into the moving pockets, an insert feeder which feeds preprinted inserts into an open jacket held in the moving pockets, and a product remover which removes jackets with the insert therein from the moving pockets. The endless conveyor moves the pockets from the jacket feeder to the insert feeder and then to the product remover.

Typically, an insert feeder has a storage unit or tray assembly for storing the preprinted inserts, a vacuum arrangement which separates one insert from the storage unit, and a revolving drum which grips, extracts and transports the insert into an open jacket held in the moving pocket.

Inserts can comprise anywhere from a single sheet of paper to a plurality of sheets which form a single booklet. Inserts are preprinted using conventional printing machines which are separate and apart from the insert feeder. As such, the printing of the insert takes place in one location which is separated from the insert machine, which is in another location. Additionally, these preprinted inserts must be stored separately from the insert machine which requires a large storage space.

Printing of inserts must be planned well in advance. For a weekly magazine, this is not a problem, but for a daily newspaper, this can mean the loss of revenue from last minute advertising.

Newspaper printing presses allow changes to the preprinted insert copy up to press time only. Once printed, these preprinted inserts must be stacked, transported, stored, and retrieved in time for insert processing. As such, last minute changes to the copy of the insert cannot be done.

There is a need to decrease this processing time, provide flexibility to change the copy of the insert up to the time of inserting, and decrease storage and handling of inserts.

SUMMARY OF THE INVENTION

A device has now been discovered which dramatically decreases processing time of inserts, increases flexibility by allowing the copy of the insert to be changed up to the time of inserting and decreases storage and handling of inserts. The device of the present Invention prints the insert on demand and immediately feeds the printed insert into a moving element of an insert machine. By controlling the printer and printing immediately before inserting, each insert can be printed with a different image and each differently printed insert can be fed into an adjacent, moving pocket of an insertion machine.

The insert printing device of the present Invention is a combined insert feeder and printer which prints directly onto an insert to produce a printed insert and then transports the printed insert into an open jacket of a moving pocket. More specifically, the device of the present Invention employs a printer which prints directly onto an insert; a feeder which stores and feeds individual inserts to a transporter; and a transporter which transports insert from the feeder to the printer and then transports the printed insert into the open jacket of a moving pocket. There are a number of advantages provided by the present Invention.

First, by having the insert printing device act as both a printer and an insert feeder simultaneously, waste of old preprinted inserts is eliminated. This saves money associated with the waste of old preprinted inserts, and eliminates handling and storage of preprinted inserts.

Second, a high degree of flexibility and speed are provided by printing the inserts immediately before they are fed into the open jacket. An advertiser can call and place an order for an advertisement minutes before the newspaper is printed. Provided there is enough time to program the printer, the newspaper can be assembled with the last-minute advertisement.

Third, the present Invention increases the flexibility of the insert machine. Often, newspapers or magazines are intended for certain zones or neighborhoods or individual addresses. By employing the insert printing device of the present Invention, the device can be programmed to insure a specific insert is printed for a newspaper intended for a specific zone or individual's address. In fact, each insert can be printed differently.

Fourth, one insert printing device can be used to feed different inserts without the need to change the paper. Thus, in accordance with the present Invention, a single insert printing device can print different imaged inserts and then insert the different printed insert into a different open jacket.

Fifth, the insert printing device of the present Invention can also feed preprinted inserts to the open jacket. This is accomplished either by turning off the printer and allowing the preprinted insert to be transported to the open jacket via the transporter, or by commanding the feeder to feed the insert directly into the moving pocket. Such an arrangement also increases the flexibility of the present Invention.

Sixth, the stored insert may contain some preprinted image. This allows for customizing the preprint insert just before insertion into the open jacket.

Broadly, the present Invention is an insert printing device for an insert machine that feeds and prints inserts to a moving element comprising:

a) a printer for printing on individual inserts;

b) a feeder for feeding inserts individually to a transporter; and c) a transporter for transporting individual inserts from said feeder through said printer, such that said printer prints on individual inserts and then transporting individual printed inserts to a moving element.

Preferably, the moving element is a moving pocket or a moving surface that collects inserts into a package.

The present Invention is also directed to an insert machine with an insert printing device that feeds inserts to a moving element, wherein at least one of said insert printing devices comprises:

a) a printer for printing on individual inserts;

b) a feeder for feeding inserts individually to a transporter; and c) a transporter for transporting individual inserts from said feeder through said printer, such that said printer prints on individual inserts and then transporting individual printed inserts to a moving element.

The feeder employed in the present Invention includes any conventional feeder mechanism which can store and move an insert. Typically, such feeders employ a tray assembly for storing inserts, suckers for separating one insert from the tray assembly, and grippers, a drum, wheels and/or belts which make contact with the separated insert to convey the insert in a linear direction.

The transporter employed in the present Invention includes any conventional mechanism that can move an insert. Such transporters typically employ grippers, registration pins, wheels and/or belts which make physical contact with the insert to convey the insert in a linear direction. The transporter has a positioning means for maintaining the orientation of said insert as it moves through the printer. The positioning means is a vacuum unit, belts, rollers or grippers.

Preferably, the transporter can change the speed of the insert anywhere along the path of the insert. More specifically, the transporter decelerates the insert before the printer and accelerates the insert after said printer. This speed change is to accommodate the speed of the printer and the speed of the moving conveyor or pocket.

The printer comprises a print controller and a printing unit; the print controller is an independent controller which communicates only with said printing unit, or communicates with an insert feeder machine controller and the printer unit; or the print controller is made part of insert machine controller. The print controller, e.g. a microprocessor, stores image data and allows for control and synchronization of the image onto the insert.

Any type of printing unit can be used in the present Invention. Suitably, the printing unit used in the present Invention is an inkjet, laser or a photocopy-type drum. The, printing unit can accept different size paper and different thickness of paper.

Preferably, the printer prints the same or different image onto the insert for each moving element.

The feeder feeds inserts either to the transporter or directly into the moving elements.

BRIEF DESCRIPTION OF THE DRAWINGS

These and other aspects of the present Invention may be more fully understood by reference to one or more of the following drawings.

DETAILED DESCRIPTION OF THE INVENTION

Figure 1:
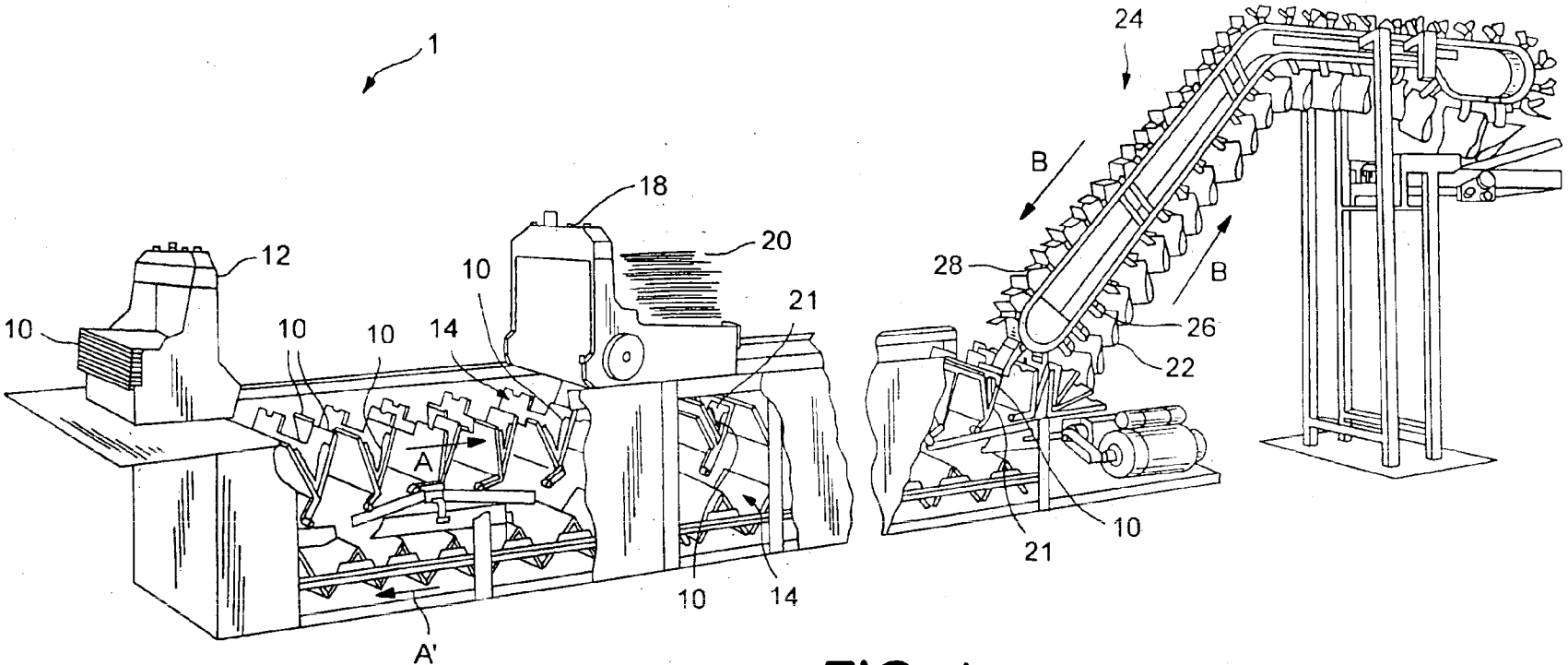
FIG. 1 illustrates an overview of an insert machine with insert printing device.

FIG. 1 illustrates an overview of insert machine 1 in accordance with the present Invention used for newspaper jacket 10. Insert machine 1 comprises jacket feeder 12 which is of conventional construction and operated in a conventional manner. Jacket 10 is fed into moving pocket 14 by jacket feeder 12 as pocket 14 passes underneath jacket feeder 12 in the direction of arrow A. Pocket 14 is moved by a pocket conveyor in a conventional manner.

After jacket 10 is dropped into pocket 14, pocket 14 operates in a conventional manner to open jacket 10. Pocket 14 typically has a movable wall and a fixed wall with an opening unit which opens jacket 10 and holds jacket 10 open as it passes under insert printing device 18. Insert printing device 18 prints onto insert 20, and then feeds printed insert 21 into open jacket 10 to form a package 22.

Next, package 22 in pocket 14 is carried to product remover 24. Product remover 24 comprises gripper 26 affixed to moving conveyor 28 which travels in direction B carrying package 22. Package 22 is released onto a package processing device. Empty gripper 26 returns along path B' to pick up another package 22. Empty pocket 14 returns in a direction marked by arrow A' to jacket feeder 12.

Although FIG. 1 illustrates only one insert printing device 18, it will be appreciated that a plurality of insert printing device 18 can be positioned along the path of pockets 14. Additionally, conventional insert feeders which feed preprinted inserts along with the insert printing device of the present Invention, can be positioned along the path of pockets 14.

Figure 2:
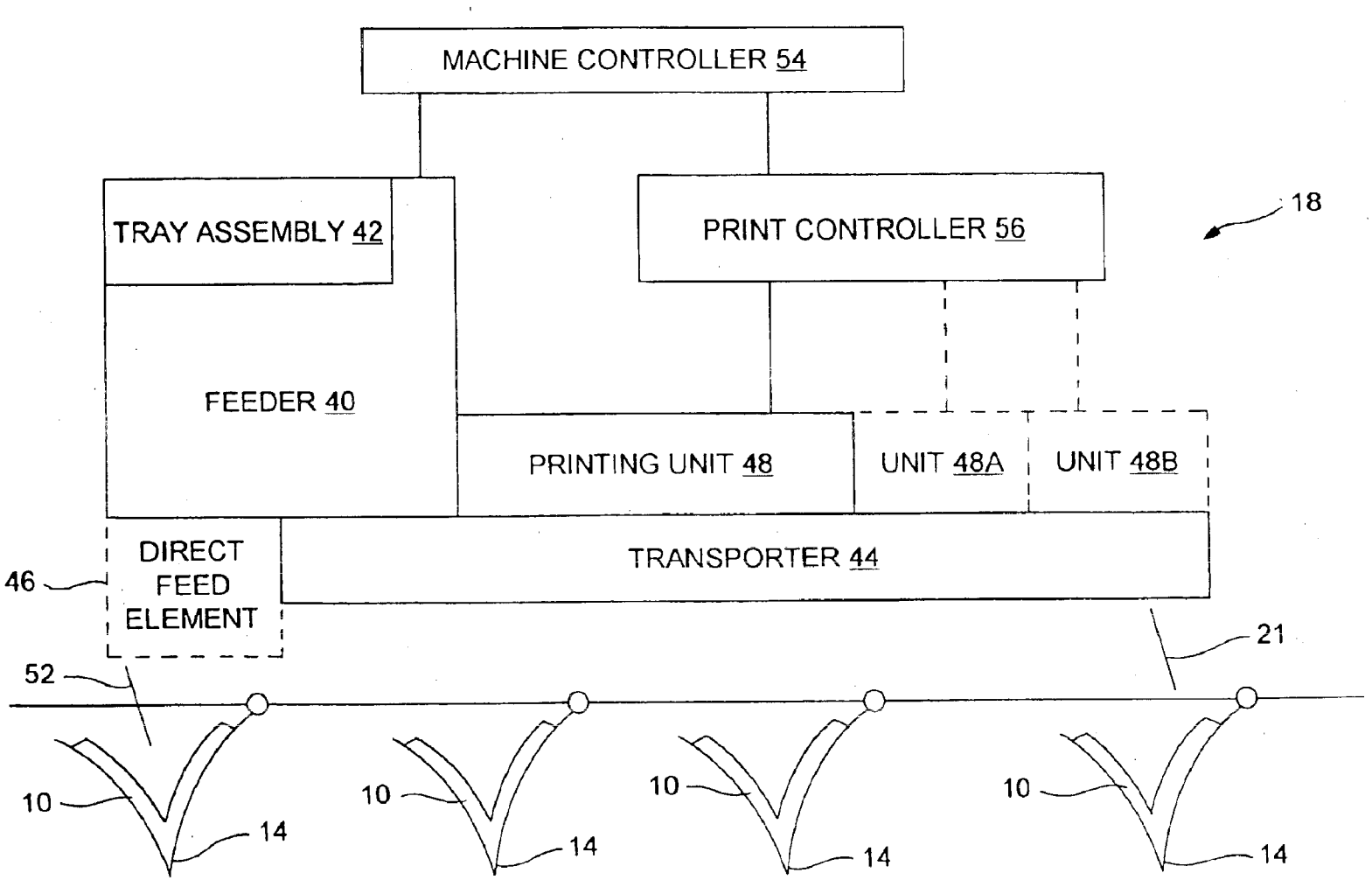
FIG. 2 illustrates a block diagram of an insert printing device in accordance with the present Invention.

FIG. 2 illustrates a general block diagram of insert printing device 18 of the present Invention. Feeder 40 has tray assembly 42 for storing inserts 20. Feeder 40 separates one insert at a time from tray assembly 42 and feeds the separated insert to transporter 44. Transporter 44 then moves insert 20 through printing unit 48 wherein printing unit 48 prints onto insert 20 to make printed insert 21.

Transporter 44 then feeds printed insert 21 into open jacket 10 in moving pocket 14.

Insert machine controller 54 commands and controls feeder 40. Transporter 44 is keyed to feeder 40 in a conventional way so as to synchronize the movement of inserts 20 and 21 in feeder 40 and transporter 44.

Print controller 56 stores and controls the image printed onto insert 20 by printing unit 48. Print controller 56 is suitably connected to printing unit 48 by a communication link, e.g. wire. Alternatively, when print controller 56 is incorporated into machine controller 54, then machine controller 54 controls printing unit 48.

Preferably, insert printing device 18 of the present Invention has direct feed element 46 which feeds insert 20 from feeder 40 into open jacket 10 in moving pocket 14 without insert 20 going to transporter 44. This allows the insert printing device 18 of the present Invention to operate as a conventional insert feeder. In such a case, tray assembly 42 is loaded with preprinted inserts 52. Machine controller 54 suitably controls feeder 40 to direct the path of the insert either to direct feed element 46 or transporter 44.

In the situation where preprinted insert 52 is loaded into tray assembly 42, and moved by feeder 40 and transporter 44 to moving pocket 14, machine controller 54 commands print controller 56 not to print on preprinted insert 52. Furthermore, print controller 56 can store a plurality of images and machine controller 54 commands print controller 56 which images to send to printing unit 48 for printing onto insert 20.

Print controller 56 is suitably a computer with keyboard and screen, however, print controller 56 can also be an image transfer device such as the type used in a photocopy or facsimile machine.

It will be appreciated by those of skill in the art that the mechanism used to store and move inserts can be any conventional mechanism. Tray assembly 42, the feed mechanism of feeder 40 can be any conventional storage and feed mechanisms for blank paper. Likewise, transporter 44 used to move the insert from feeder 40 through printer 48 to moving pocket 14 can be any conventional mechanism. As shown in FIG. 2, gravity and some momentum from transporter 44 causes printed insert 21 to drop into moving pocket 14. There are many conventional mechanisms which can be adapted to move a sheet of paper from printer 48 to an exit port of insert printing device 18.

No matter what mechanism is used to move the inserts, the movement of the inserts must be synchronized with the movement of pocket 14. Such synchronization is accomplished in a conventional way such as using insert machine controller 54 or by conventional gearing mechanism.

Controller 54 can be any conventional unit normally used to control electronic equipment and to synchronize the operation of the various elements in an insert machine. Suitable controls include microprocessors.

Printing unit 48 can be any conventional printing apparatus which operates at a speed suitable for use with insert machine 1. Suitable printing apparatus include laser, inkjet, or any conventional type of printing machine. Furthermore, as shown in FIG. 2, (more than one printing unit can be used in the present Invention. Specifically, FIG. 2 illustrates three printing units, printing unit 48, printing unit 48*a* and printing unit 48*b*, each of which is controlled by print controller 56.

Figure 3:
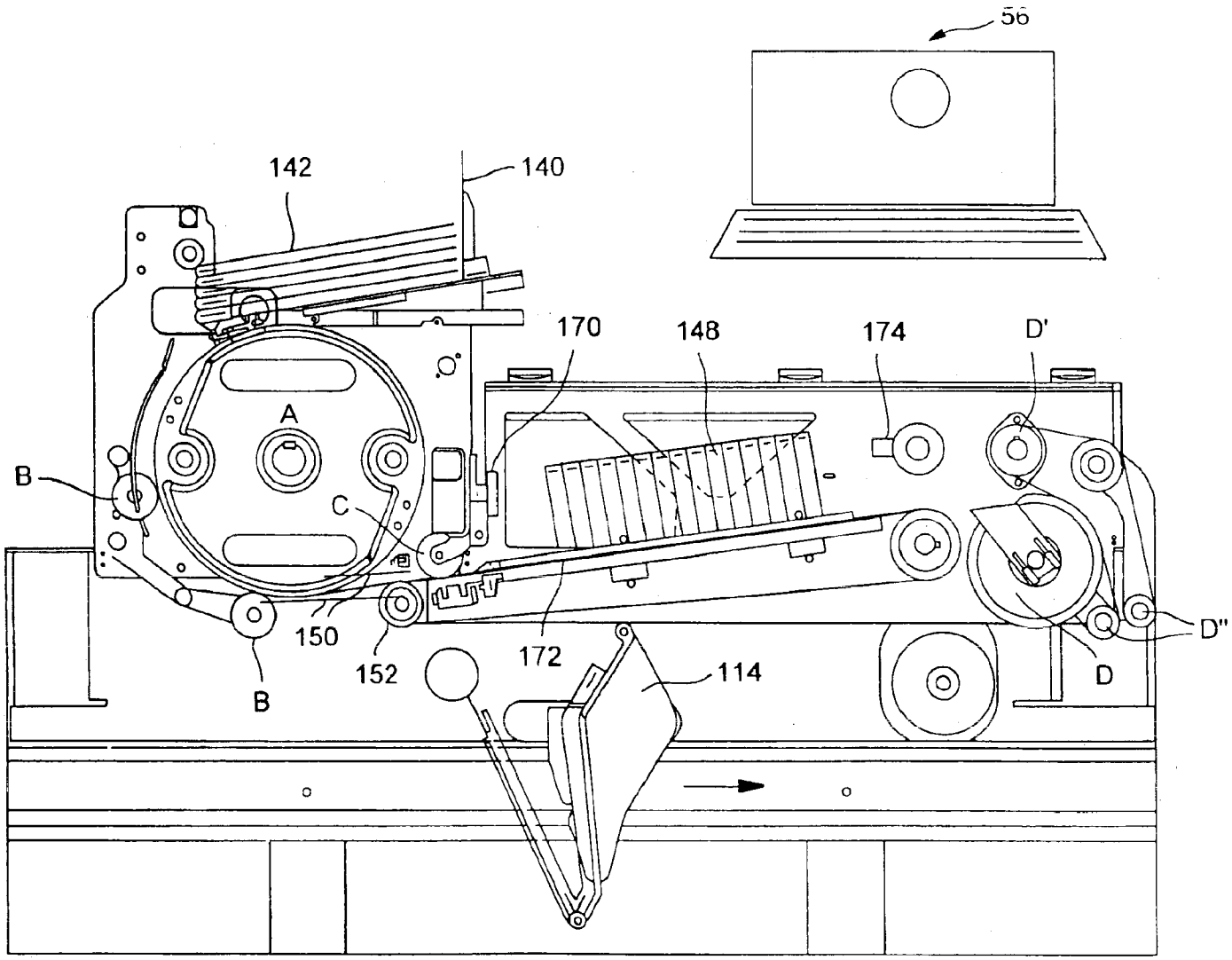
FIG. 3 illustrates a preferred embodiment of the insert printing device in accordance with the present Invention.

FIG. 3 illustrates a preferred embodiment of the present Invention. Insert 142 is fed from tray assembly 140 via drum A and rollers B which, in turn, passes insert 142 to transport mechanism 152 and printer 148. Printer 148 prints onto insert 142 to create a printed insert which is then conveyed by transport mechanism 152 to moving pocket 114. As shown in FIG. 3, drum A and rollers B feeds a single sheet insert 142 to printer 148. Suitably, the speed of insert 142 on drum A and rollers B is about twice the speed of the insert conveyed via transporter 152 through printer 148.

As insert 142 is transported around drum A, it comes into contact with follower rollers B. As insert 142 leaves the second follower roller B, assisted by top and bottom guides 150, its leading edge comes into contact with slowdown roller C. Slowdown roller C slows down the speed of insert 142 to about half the speed it had on drum A and rollers B. Photoelectric queuing eye 170 detects the leading edge of insert 142 and the transport speed of insert 142 is measured by encoder 174 as it is conveyed via transport 152 with assistance of vacuum transport mechanism 172 to and through printer 148. Printer 148 is an inkjet type printer that comprises a number of printing heads which are suitably inkjet heads which print onto the surface of insert 142. After printer 148 prints, the printed insert is picked up by belt rollers D, D' and D" and accelerated to about twice the speed at which the insert moved through printer 148. This acceleration allows the insert to catch up with the speed of movement of pocket 114. Encoder 174 monitors the speed of the insert being transported through printer 148 and sends signals to print controller 56.

It will be appreciated by those of skill in the art, as insert 142 leaves drum A and rollers B, its flat shape must be maintained stable with top and bottom guides 150 as it comes in contact with slowdown roller C.

Suitably, the printer employs conventional mechanism to adjust for varying thickness of different paper used for inserts.

It will be understood that the claims are intended to cover all changes and modifications of the preferred embodiments of the Invention herein chosen for the purpose of illustration which do not constitute a departure from the spirit and scope of the present Invention.

What is claimed is:

1. An insert printing device for an insert machine that feeds printed inserts to a moving element comprising:

(a) a printer for printing on individual inserts;

(b) a feeder having a tray assembly for storing inserts and a means for separating and conveying individual inserts from said tray assembly; and (c) a transporter for transporting individual inserts from said means for separating and conveying through said printer, such that said printer prints on individual inserts, and transports individual printed inserts to a moving element, wherein said transporter decelerates said insert before said printer and accelerates said insert after said printer.

2. The device of claim 1 wherein said printer is an inkjet printer or a laser printer.

3. The device of claim 1 wherein said moving element is a moving pocket or a moving surface that collects inserts into a package.

4. The device of claim 1 wherein said transporter is a moving belt, rollers, grippers or registration pins.

5. The device of claim 1 wherein said transporter has a positioning means for maintaining orientation of said insert through said printer.

6. The device of claim 5 wherein said positioning means is a vacuum unit, belts, rollers, or grippers.

7. The device of claim 1 wherein said printer has a controller and a printing unit, said controller is an independent controller that communicates only with said printing unit, or communicates with an insert feeder machine controller and said printing unit; or said controller is part of said insert machine controller.

8. The device of claim 1 wherein said means for separating and conveying feeds inserts either to said transporter or directly into said moving elements.

9. The device of claim 1 wherein said printer prints the same or different image on said insert for each moving element.

10. In an insert machine having insert feeders that feed inserts to a moving element, the improvement comprising: an insert printing devices which comprises:

(a) a printer for printing on individual inserts;

(b) a feeder having a tray assembly for storing inserts and a means for separating and conveying individual inserts from said tray assembly; and (c) a transporter for transporting individual inserts from said means for separating and conveying through said printer, such that said printer prints on individual inserts, and transports individual printed inserts to a moving element, wherein said transporter decelerates said insert before said printer and accelerates said insert after said printer.

11. The machine of claim 10 wherein said printer is an inkjet printer or a laser printer.

12. The machine of claim 10 wherein said moving element is a moving pocket or a moving surface that collects inserts into a package.

13. The machine of claim 10 wherein said transporter is a moving belt, rollers, grippers or registration pins.

14. The machine of claim 10 wherein said transporter has a positioning means for maintaining orientation of said insert through said printer.

15. The machine of claim 14 wherein said positioning means is a vacuum unit, belts, rollers, or grippers.

16. The machine of claim 10 wherein said printer has a controller and a printing unit, said controller is an independent controller that communicates only with said printing unit, or communicates with an insert feeder machine controller and said printing unit; or said controller is part of said insert machine controller.

17. The machine of claim 10 wherein said means for separating and conveying feeds inserts either to said transporter or directly into said moving elements.

18. The machine of claim 10 wherein said printer prints the same or different image on said insert for each moving element.

* * * * *